US005249524A

United States Patent [19]

Morris, deceased

[11] Patent Number: 5,249,524

[45] Date of Patent: Oct. 5, 1993

[54] CONTAINER BODY INKING APPARATUS

[75] Inventor: Edwin C. Morris, deceased, late of Golden, Colo., by Carol J. Morris, legal representative

[73] Assignee: Ball Corporation, Muncie, Ind.

[21] Appl. No.: 892,891

[22] Filed: Jun. 3, 1992

[51] Int. Cl.[5] ..... B41F 31/34; B41F 35/04

[52] U.S. Cl. ..... 101/352; 101/425

[58] Field of Search ..... 101/349, 350, 351, 352, 101/207-210, 148, 423, 424, 425

[56] References Cited

U.S. PATENT DOCUMENTS

| | | | |
|---|---|---|---|
| 3,186,338 | 6/1965 | Peyrebrune et al. | 101/352 |
| 3,223,028 | 12/1965 | Brigham | 101/40 |
| 3,603,254 | 9/1971 | Siebke | 101/352 X |

OTHER PUBLICATIONS

"CMP Hi-Speed", Rutherford Machinery, Published May 22, 1974, 2nd Edition.

*Primary Examiner*—J. Reed Fisher

*Attorney, Agent, or Firm*—Gilbert E. Alberding

[57] ABSTRACT

An apparatus for applying ink to a printing plate which utilizes a plurality of successive, interconnected/interfacing rollers to provide a desired film thickness of ink to the printing plate such that a desired design may be transferred to a container body. In one embodiment, two transfer rollers directly engage the cylinder upon which the printing plate is positioned. The orientation of these rollers may be adjusted in a manner to enhance the distribution of ink to the printing plate. Advantageously, this adjustment does not require the positioning of any components within the roller body area (e.g., an area through which ink propelled away from the rollers would travel). In order to further enhance the distribution of ink, at least one of the rollers of the inker oscillates to alternately engage two adjacently positioned rollers. This oscillation is also provided without requiring components within the defined roller body area.

19 Claims, 10 Drawing Sheets

CONTAINER BODY INKING APPARATUS

FIELD OF THE INVENTION

The present invention generally relates to an apparatus having a plurality of successive, interconnected/interfacing rollers for applying ink to a printing plate which thereafter transfers a particular design onto a container body. More particularly, the present invention relates to such an apparatus which has a simplified construction through a reduction of components, including those within the roller body area which advantageously reduces the potential for container body printing defects.

BACKGROUND OF THE INVENTION

The printing of metal container bodies typically involves the interaction of a number of machines, namely one or more inkers, a blanket wheel assembly, and a spindle wheel assembly. Each inker includes a plurality of successive, interconnected/interfacing rollers (i.e., adjacent roller bodies engaging at least intermittently) which ultimately provide a desired film of ink of a given color onto a printing plate positioned on a rotating plate cylinder. The printing plate has raised portions thereon coinciding with the desired design (a reverse image thereof) and transfers such design onto a blanket positioned on a peripheral portion of the rotating blanket wheel assembly by direct contact therewith. The inkers are thus circumferentially spaced and attached to the periphery of the blanket wheel assembly such that each inker transfers its specific design onto a given blanket during rotation of the blanket wheel assembly. Once the full design (i.e., all of the colors to be used for a given container body) is positioned upon a blanket by the inker(s), the blanket is rotated into engagement with a rotating container body positioned on a peripheral portion of the rotating spindle wheel assembly to transfer the design onto the container body.

As can be appreciated, printing defects on container bodies either enhances material costs (i.e., if identified the container body is scrapped) or affects the consumer's perception of the manufacturer (i.e., if the printing defect is not identified prior to distribution and the consumer thereafter identifies the defect). Consequently, it is desirable in either instance to reduce the amount of such printing defects. Although there are a plurality of potential sources for printing defects, a significant portion of such defects are attributable to ink slinging from the various rollers of the inker during operation.

When the inker is operated at production capacity, its rollers are rotating at a relatively high speed and thus there is a tendency for ink to be propelled away from the surfaces of such rollers. In the event that any structure of the inker is positioned within the area through which this ink may be propelled, ink may collect on such structure and thereafter be deposited upon, for instance, the printing plate in an undesirable/uncontrolled manner (e.g., dripping). As can be appreciated, this will produce a printing defect on the container body. Therefore, in order to reduce the potential for these types of defects due to such ink slinging, it would be desirable to remove as much of the inker's structure from this area as possible without adversely affecting the operation of the inker.

SUMMARY OF THE INVENTION

The present invention is an inking apparatus which is used for printing container bodies. Generally, the present invention includes a plurality of successive, interconnected/interfacing rollers which provide a desired film thickness of ink to a printing plate positioned on a rotating cylinder. The printing plate has raised portions thereon to define a desired design (a reverse image thereof) which is transferrable to the container body.

The plurality of rollers of the inking apparatus of the present invention effectively define a roller body area. More particularly, during operation the rotation of the rollers has a tendency to sling ink away (e.g., outwardly) from such rollers. The area through which this ink travels is the roller body area for purposes of the present invention. Since these rollers are typically substantially cylindrical and parallel to each other, this area through which the slinging ink travels is effectively a radially outward projection from the plurality of rollers, the lateral extent of which is thus defined by the width of the rollers. More particularly, the roller body area is that collective area defined by a plurality of radii which project outwardly from the rotational axis of each of the rollers in a substantially perpendicular manner to the associated rotational axis.

In one aspect of the present invention, means are provided to adjust the orientation of the rollers which directly contact the printing plate in order to ensure that the ink is distributed onto the printing plate in a desirable manner. Advantageously, the mechanism utilized in providing for this type of adjustment is positioned externally of the above-defined roller body area. Therefore, the potential is reduced for ink being propelled away from the rotating rollers, collected on structure of the inking apparatus, and deposited in a manner which adversely affects the design transferred to the container body from the printing plate.

With regard to this particular aspect of the present invention, in one embodiment the inking apparatus generally includes first, second, third, and fourth rollers and a rotatable cylinder having a printing plate attached thereto, the rotational axes and engaging surfaces of each of the rollers and the cylinder being substantially parallel. Generally, ink that is directly provided to the first roller is ultimately rolled out to a desired film thickness and transferred to the printing plate. More particularly, the first roller is interconnected with the second roller which directly engages both the third and fourth rollers. The third and fourth rollers each then directly engage the cylinder such that upon rotation of at least one of the first, second, third, or fourth rollers, ink effectively flows down through such rollers and onto the printing plate positioned on the cylinder. In order to ensure that the ink is desirably distributed onto the printing plate, the pressure applied by the third and fourth rollers to the printing plate, as well as the orientation of the rotational axis of each of the third and fourth rollers, is adjustable and is positioned externally of the defined roller body area to provide the above-described advantages.

Various features relating to the described roller adjustment aspect may be incorporated to further enhance the distribution of ink on the printing plate. For instance, the third and fourth rollers may be independently adjusted which accounts, for instance, for differing initial configurations of the third and fourth rollers (e.g., the surfaces of the third and fourth rollers which interact with the printing plate may not be exactly the same) and/or for unequal wearing of such rollers during operation. Moreover, the position of each end of each of the third and fourth rollers may be independently adjusted, which allows for both a correction of a skewing of the positioning of each of the third and fourth rollers relative to an interfacing surface of the cylinder and/or for changing the application of pressure by each of the third and fourth rollers to the printing plate. These types of features may be provided by pivotally connecting each of the third and fourth rollers about the rotational axis of the second roller.

When utilizing the above-described pivotal connections, both ends of each of the third and fourth rollers are positioned within a bracket (i.e., there is one bracket for each end of each roller) which effectively pivotally engages the shaft of the second roller. The bracket on a first end of the third roller is displaced from the bracket on the first end of the fourth roller, and there is a similar displacement of the brackets on the second, opposite ends of the third and fourth rollers. Consequently, there is a scissor-like configuration on each end of the second roller defined by the described brackets.

A stationary block is positioned between each of the pairs of displaced brackets on the ends of the rollers and a separate adjusting screw interacts with each bracket and the associated stationary block. Rotation of one of the adjusting screws in one direction thereby pivots the one end of the associated third or fourth roller about the rotational axis of the second roller and away from the printing plate, whereas rotation of the same adjusting screw in the opposite direction pivots the same end of the associated third or fourth roller about the rotational axis of the second roller and toward the printing plate. Therefore, this allows for independent adjustment of the third and fourth rollers to achieve a respective parallel interaction with the surface of the printing plate (e.g., by rotating one of the adjusting screws to pivot one end of the associated third or fourth roller to alleviate any skewing), as well as for independent adjustment of the pressure applied by each of the third and fourth rollers to the printing plate (e.g., by rotating each adjusting screw on both ends of the associated third or fourth roller in a substantially equal amount to maintain the parallel nature of the interaction with the printing plate and to modify the pressure applied thereto).

In another aspect of the present invention, at least one of the rollers of the inking apparatus effectively oscillates between two positions to alternately engage two rollers positioned adjacent thereto to provide for an enhanced distribution of ink to such rollers and ultimately the printing plate. Advantageously, the mechanism utilized for producing this oscillatory motion may be positioned externally of the above-defined roller body area to further reduce the potential for printing defects associated with ink slinging and the subsequent undesirable/uncontrolled depositing of such ink. Means may also be provided to terminate this oscillatory motion by disconnecting the above-identified mechanism from the roller, and such may also be positioned externally of the roller body area.

With regard to this particular aspect of the present invention, in one embodiment the inking apparatus includes first, second, third, and fourth rollers for transferring ink to a printing plate positioned on a rotatable cylinder. In order to enhance the distribution of ink, the second roller oscillates between two positions to alternately engage the first and third rollers. Consequently, ink applied to the first roller is transferred to the third roller by the described oscillation of the second roller and is ultimately distributed upon the printing plate as a result of rotation of at least one of the first, second, third, or fourth rollers. Preferably, the entire mechanism utilized to produce this oscillation of the second roller is positioned externally of the roller body area. For instance, in the event that the second roller is pivotally incorporated within the inking apparatus by two pivot arms such that it may be pivoted between two positions to produce the described oscillation, the required components can all be positioned externally of the roller body area. In this regard, a cam follower may positioned on one of the pivot arms and a drive cam may be positioned to engage the cam follower, both of which may be positioned externally of the roller body area. Moreover, preferably only pivot pins are used to pivotally connect the pivot arms of the second roller to the inking apparatus versus a pivot shaft, which, as can be appreciated, would extend across the roller body area. Therefore, the number of components in the roller body area utilized in this aspect of the present invention is desirably reduced, thereby reducing the potential for printing defects associated with ink slinging.

Under some circumstances it may be desirable to terminate the above-described oscillatory motion of the second roller. In this instance and with regard to the above-described embodiment, a pivotable lock-out cam may be utilized to disconnect the drive cam from the cam follower such that they are displaced from each other. Therefore, any subsequent rotation of the drive cam will have no effect on the position of the second roller. Since the drive cam, cam follower, and pivot arms may be positioned externally of the roller body area as noted, the lock-out cam may be similarly positioned to further enhance realization of the above-described advantages with removing components of the inking apparatus from the roller body area.

DETAILED DESCRIPTION

The present invention will be described with reference to the attached drawings which assist in illustrating the pertinent features thereof. Generally, the present invention is an apparatus which utilizes a plurality of successive, interconnected/interfacing rollers which provide a desired film thickness of ink to a printing plate having raised portions thereon which define the desired design (a reverse image thereof) to be transferred to a container body. More particularly, the present invention provides a simplified construction of such an inking apparatus, including a reduction of the number of components within the above-defined roller body area. As a result, the amount of ink which collects within the apparatus from the slinging of ink from the rollers during rotation thereof is reduced. Therefore, the potential for such ink being deposited upon, for instance, the printing plate in an undesirable/uncontrolled manner is also reduced, thereby reducing the amount of container body printing defects associated with ink slinging.

Figure 1:
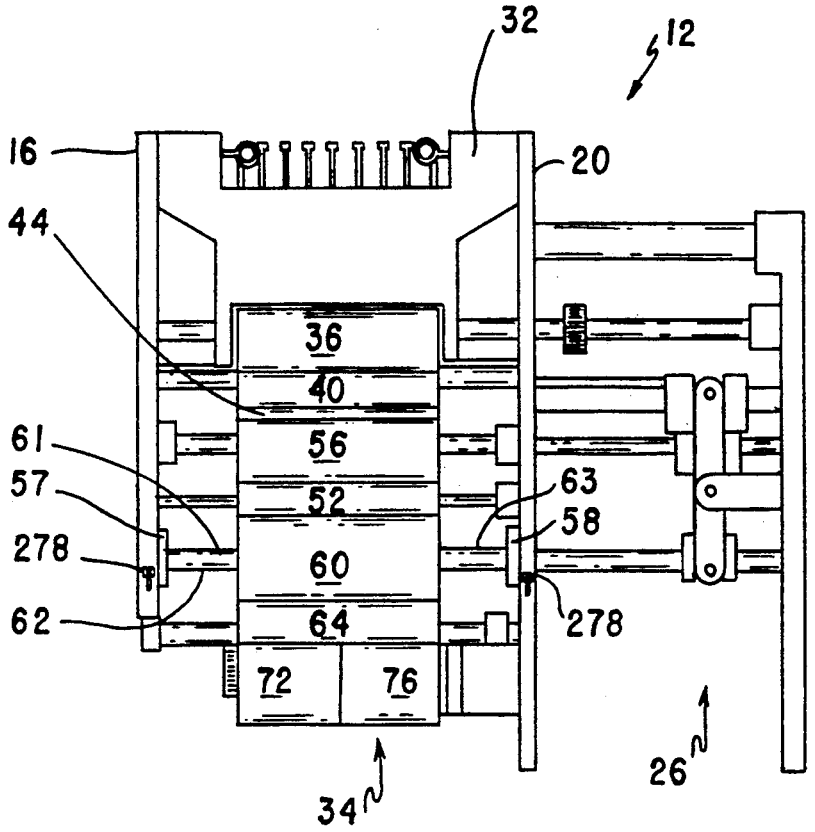
FIG. 1 is a front view of one embodiment of an inking apparatus of the present invention.
Figure 2:
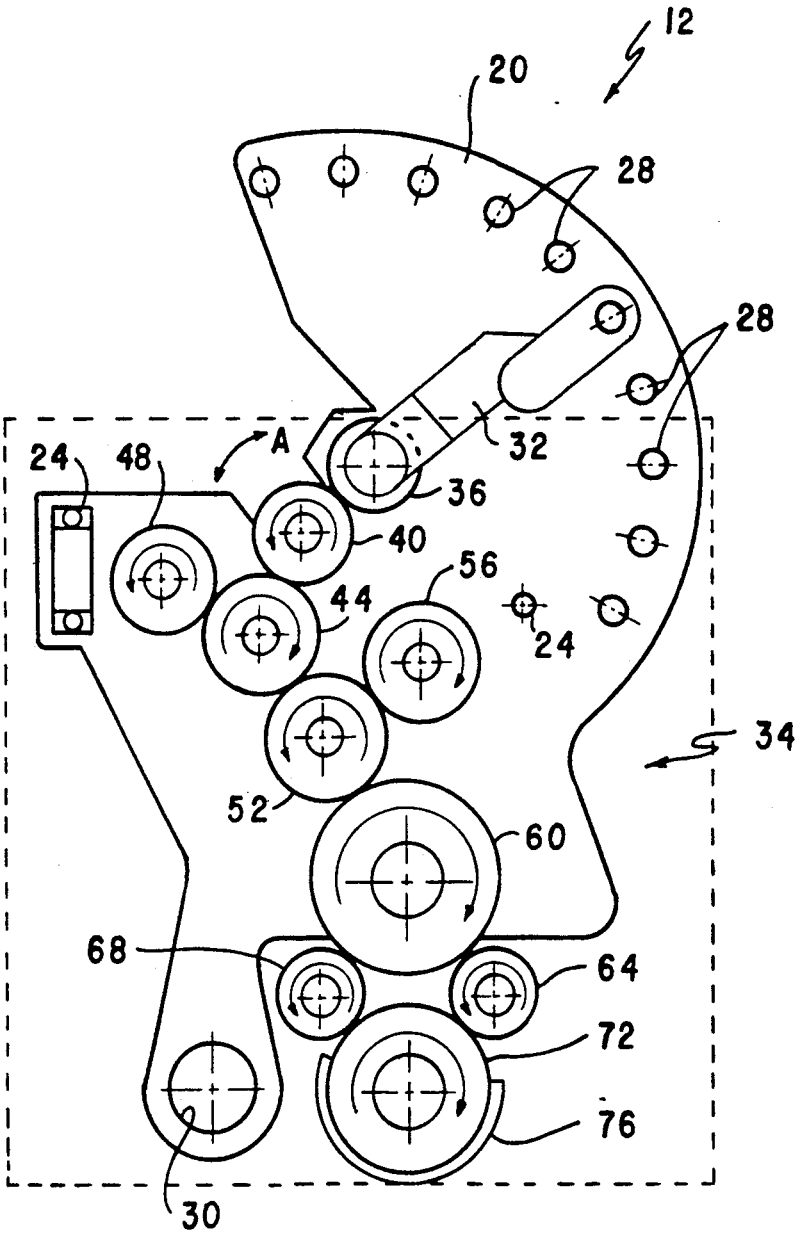
FIG. 2 is a cutaway side view of the inking apparatus of FIG. 1.

One embodiment of the present invention is illustrated in FIGS. 1-2. Generally, the inker 12 utilizes a plurality of successive, interconnected/interfacing rollers (discussed in more detail below) which progressively roll out a layer of ink. This layer of ink is applied to a printing plate 76 which is mounted upon a rotating plate cylinder 72. In order to ultimately transfer the design from the printing plate 76 to a container body (not shown), the inker 12 is mounted upon a peripheral portion of a rotating blanket wheel assembly (not shown) utilizing the mountings 30 (only one shown) such that the printing plate 76, having the desired distribution of ink thereon, may transfer its design to a blanket (not shown) positioned on an adjacent, peripheral portion of the blanket wheel assembly. Since many container bodies incorporate a multicolored design, a plurality of inkers 12 would be mounted and circumferentially spaced on the blanket wheel assembly in this instance such that each inker 12 would apply its particular design (one color) to the blanket. After all of the inkers 12 transfer their respective designs to the blanket in the described manner, the blanket would engage a container body positioned on a peripheral portion of a spindle wheel assembly, peripheral portions of the spindle wheel assembly and blanket wheel assembly being adjacently located to provide for this transfer of the inked design.

Continuing to refer to FIGS. 1-2, the structure of the inker 12 is primarily defined by left and right support plates 16, 20 which are interconnected by a plurality of horizontal support members 24. The above-identified plurality of successive, interconnected/interfacing rollers are rotatably positioned between the support plates 16, 20 in substantially horizontal and parallel fashion to progressively roll out a layer of ink to be provided to the printing plate 76. In this regard, an ink applicator 32 is pivotally positioned on an upper portion of the inker 12 to apply ink to an inking roller 36. As noted above, the inker 12 is positioned on a peripheral portion of the blanket wheel assembly (not shown) and may assume a variety positions thereon depending upon the particular container body design (e.g., the inker 12 may be positioned anywhere from a substantially vertical to a substantially horizontal position). Therefore, in order to ensure that the ink is desirably provided to the inking roller 36, a plurality of holes 28 are provided on the support plates 16, 20 such that the ink applicator 32 may be pivoted and locked into a desired position.

Figures 3, 3A:
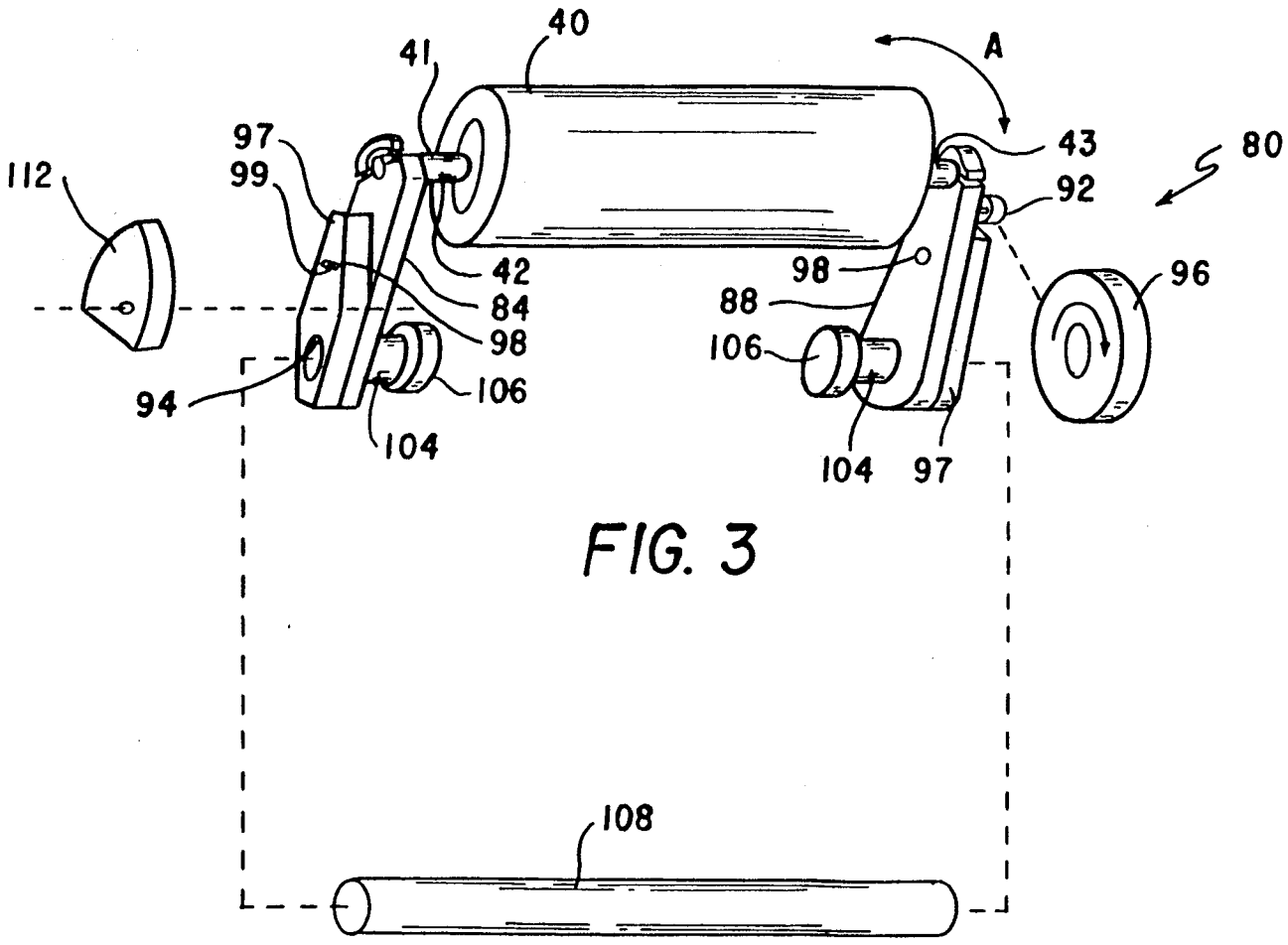
FIG. 3A (PRIOR ART)
FIG. 3 is a perspective view of an oscillating ductor roller utilized by the inking apparatus of the present invention and one embodiment of a ductor roller pivot assembly which provides for this oscillation.
FIG. 3A is a perspective view of a prior art pivot shaft.
Figure 5:
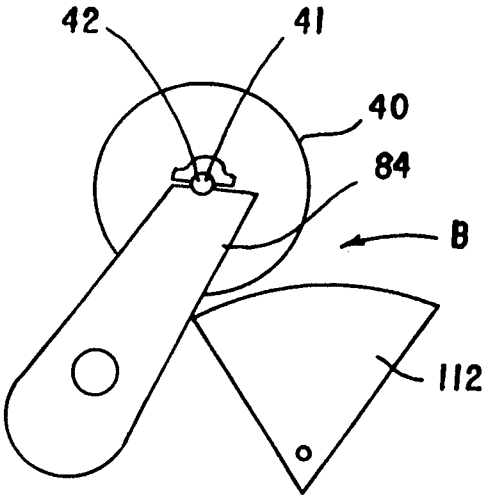
FIG. 5 is a side view of one embodiment of a lock-out cam for the ductor roller pivot assembly of FIG. 3 with support bracket removed therefrom.
Figure 4:
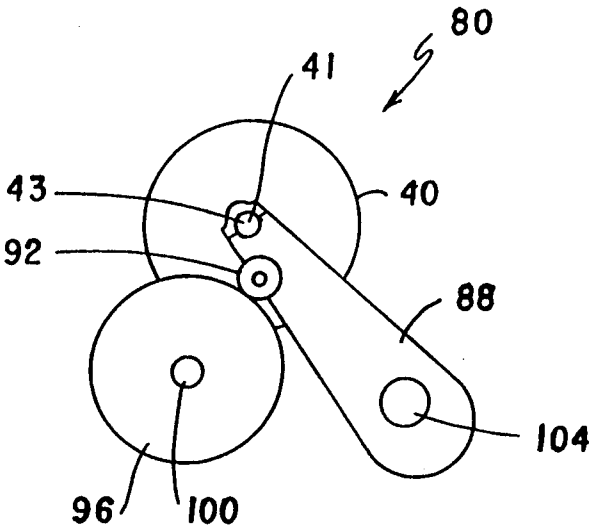
FIG. 4 is a side view of the cam-driven portion of the ductor roller pivot assembly of FIG. 3 with the support bracket removed therefrom.

A ductor roller 40 is positioned substantially adjacent to the inking roller 36 and alternately engages the inking roller 36 and a first intermediate roller 44 by generally oscillating in the direction indicated by the arrow A in FIG. 2. This alternating engagement is provided by a ductor roller pivot assembly 80 which is illustrated in FIGS. 3-5. Generally, the left and right ends 42, 43 of the ductor roller shaft 41 are rotatably supported by left and right pivot arms 84, 88, respectively, which are in turn pivotally attached to the left and right support plates 16, 20, respectively, by pivot pins 104 (shown partially removed from the support plates 16, 20 for enhanced illustration thereof). A bracket 97 may be positioned on the left and right pivot arms 84, 88 to provide additional support and may be attached to the arms 84, 88 in an appropriate manner. For instance, the brackets 97 may each have a groove 99 therein for receiving a pin 99 which is attached to the respective pivot arm 84, 88 and which extends through the groove 99. Moreover, a lower portion of each bracket 97 may be fixed relative to the associated pivot pin 104 by a key 94. Therefore, the supports 97 remain substantially stationary to support the pivot arms 84, 88 which are thus able to pivot relative thereto.

The right pivot arm 88 has a cam follower 92 attached thereto which rides along a drive cam 96, the drive cam 96 being rotatably mounted on the right support plate 20 by a cam shaft 100. The cam shaft 100 is thus driven by a drive system 26 (generally illustrated in FIG. 1 and which also rotatably drives various of the rollers of the inker 12) to thereby pivot the ductor roller 40 about the pivot pins 104 for alternate engagement with the inking roller 36 and first intermediate roller 44 as noted above.

Figure 1A:
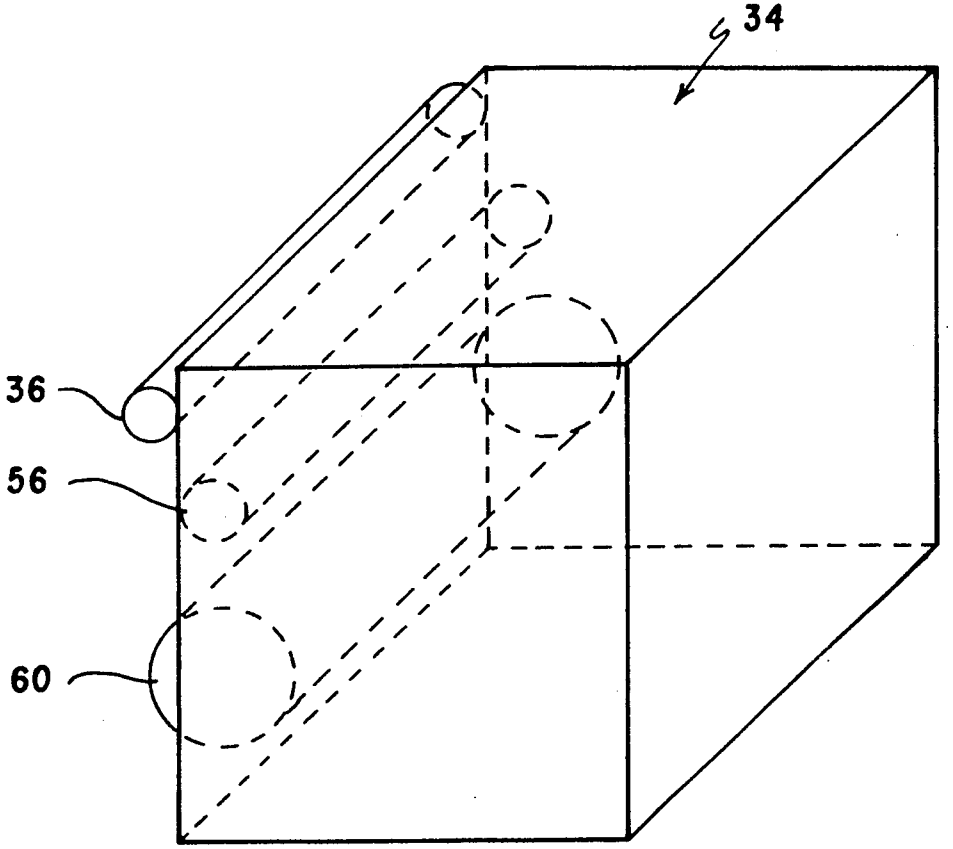
FIG. 1A is a perspective view of the forward projection of the roller body area defined by the rollers of the inking apparatus of FIG. 1.

Only the heads 106 of the pivot pins 104 are positioned interiorly of the left and right support plates 16, 20 and are in abutting engagement therewith when properly positioned for operation of the ductor roller pivot assembly 80. Consequently, the heads 106, and thus the entire structure of the pivot pins 104, are positioned exteriorly of a roller body area 34 as illustrated in FIGS. 1, 1A, and 2.

As noted above, the plurality of rollers of the present invention effectively define the roller body area 34. More particularly, during operation of the inker 12 the rotation of the rollers tends to sling ink away (e.g., outwardly) from such rollers. The area through which this ink travels is the roller body area 34 for purposes of the present invention. Since these rollers are in one embodiment substantially cylindrical and parallel to each other, as well as of substantially equal width, this area 34 through which the slinging ink may travel is effectively a rectangular projection as illustrated in FIG. 1A (only three rollers being illustrated therein and only the forward projection being depicted for clarity). This rectangular projection thus encompasses each of the rollers of the inker 12, excluding their respective shafts since ink is not applied thereto, and has a lateral extent which is defined by the width of the rollers. Therefore, the roller body area 34 is the collective area defined by a plurality of radii which project outwardly from the rotational axis of each of the rollers in a substantially perpendicular manner to the associated axis.

The Model 800 Inker manufactured by Rutherford Manufacturing, a division of Sun Chemical Corporation, utilizes a pivot shaft 108, illustrated in FIG. 3A, to provide for a pivotal motion of its ductor roller (not shown) which is functionally similar to the ductor roller 40 associated with the present invention. For purposes of illustration/comparison, the pivot shaft 108 of the Model 800 Inker would be positioned between the left and right support plates 16, 20 if incorporated into the inker 12 of the present invention as indicated by the dashed lines between FIGS. 3A and 3. Consequently, the pivot shaft 108 would be contained within the roller body area 34.

As noted above, during rotation of the various rollers of the inker 12 by the drive system 26 at the speeds required to maximize production capacity and/or to apply a proper distribution of ink to the printing plate 76, ink from the various rollers may be propelled away from such rollers and thus into/through the above-defined roller body area 34. Any structural portions of the inker 12 in the roller body area 34 may thus be potentially contacted by and collect such displaced ink. Under some circumstances, a sufficient quantity of ink may collect and thereafter be deposited onto, for instance, the rollers and/or the printing plate 76 in an undesirable/uncontrolled manner. As can be appreciated, this may adversely affect the quality of the design transferred from the printing plate 76 to the container body (not shown). Therefore, by removing the pivot shaft 108 of the Model 800 Inker from the roller body area 34 and replacing such with the functionally equivalent pivot pins 104 associated with the present invention, the potential for these types of ink deposits is reduced. Consequently, this contributes to a reduction of printing defects associated with ink slinging by utilizing the structure of the present invention versus that of the Model 800 Inker.

Under some circumstances, it may be necessary to disengage the ductor roller pivot assembly 80. Consequently, one embodiment of the present invention includes a lock-out cam 112 which is pivotally attached to the left support plate 16 as illustrated in FIGS. 3 and 5. When it is desirable to provide for such disengagement, the lock-out cam 112 is simply manually pivoted in the direction of the arrow B in FIG. 5 such that upon a subsequent pivoting of the ductor roller shaft 41 via the pivot arms 84, 88 also in the direction of the arrow B, the lock-out cam 112 further automatically pivots down in the direction of the arrow B into a set position and seats against the left pivot arm 84, thereby disengaging the cam follower 92 from the drive cam 96. By displacing these portions of the ductor roller pivot assembly 80, further rotation of the drive cam 96 will have no effect upon the positioning of the ductor roller 40.

Figure 6:
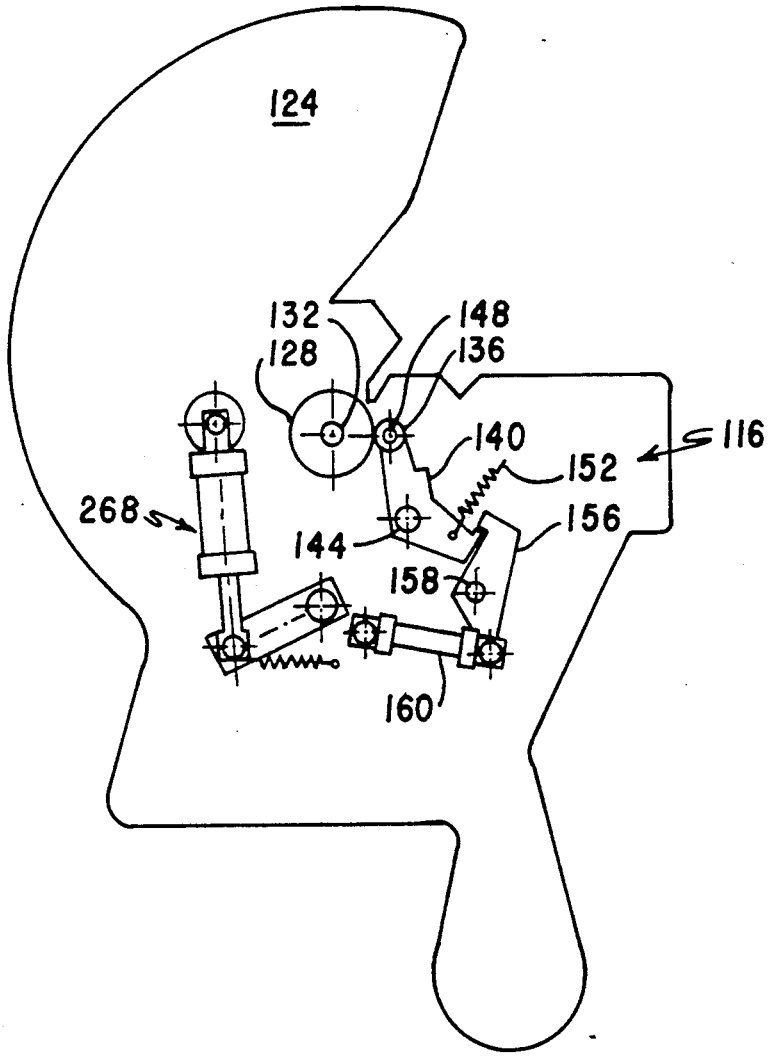
FIG. 6 (PRIOR ART)
FIG. 6 is a side view of a lock-out system for a ductor roller oscillator constructed in accordance with the prior art and of an activating portion of the prior art transfer roller adjustment mechanism of FIGS. 11A–C.

A lock-out system 116 utilized by the above-identified Model 800 Inker is illustrated in FIG. 6 as it would be attached to a right support plate 124 in which a ductor roller (not shown) would oscillate in a similar fashion to the ductor roller 40 described above with regard to the present invention. Generally, a drive cam 128 is rotatably attached to the right support plate 124 by a cam shaft 132 for engagement with a cam follower 136. The cam follower 136 is positioned on a pivot arm 140 which is pivotally attached to the right support plate 124 by a pivot shaft 144, the pivot shaft 144 extending from the right support plate 124 to the laterally displaced left support plate (not shown). Consequently, this shaft 144 would be within the area of the inker coinciding with the above-defined roller body area 34 for the inker 12.

Continuing to refer to the Model 800 Inker, a ductor roller shaft 148 is also rotatably positioned upon the pivot arm 140 and a spring 152 engages a lower portion of the pivot arm 140 to maintain contact between the cam follower 136 and the drive cam 128, and thus provides the desired oscillatory motion of the ductor roller (not shown) upon rotation of the drive cam 128. In order to terminate the oscillation of the ductor roller, the upper end of the pivot arm 140 is engageable by a lock-out arm 156 which is pivotally connected to the right support plate 120 by a pivot shaft 158. The lower end of the lock-out arm 156 is engaged by a lock-out cylinder 160. By activating the lock-out cylinder 160 to pivot the lock-out arm 156 into the position of FIG. 6, further oscillation of the ductor roller is terminated by restricting further movement of the cam follower 136 away from the drive cam 128. When the lock-out cylinder 160 is activated to pivot the lock-out arm 156 away from the pivot arm 140 (not shown), however, the ductor roller is able to generally oscillate in the above-described manner.

As can be appreciated, the above-described lock-out cam 112 of the present invention is a much simpler mechanism than the lock-out system 116 utilized by the Model 800 Inker, having fewer parts which decreases both material and maintenance costs. Moreover, the lock-out cam 112 of the present invention actually disengages the cam follower 92 from the drive cam 96 (i.e., continued rotation of the drive cam 96 will not produce any stress on the cam follower 92 or components interconnected therewith). In contrast, the lock-out system 116 utilized by the Model 800 Inker effectively acts as a brake such that if the drive cam 128 continues to rotate when the system 116 is in the position of FIG. 6, there would be significant structural stress and likely failure of at least one component thereof.

All portions of the present invention associated with the disengagement of the oscillation of the ductor roller 40 are also advantageously positioned externally of the roller body area 34 to further enhance the reduction of the potential for printing defects associated with ink slinging. In contrast, in the lock-out system 116 utilized by the Model 800 Inker the pivot shaft 144 extends through an area coinciding with the roller body area 34 as defined for the present invention, and would thus potentially collect ink which is propelled away from the rollers (e.g., portions of the system 116 would be within the area outwardly of the ductor roller 40 in the general direction of the holes 28 as illustrated in FIG. 2 if utilized by the inker 12, such as between the inking roller 36 and the fourth intermediate roller 56). As noted above, this ink has a tendency to be deposited in a manner which produces printing defects on container bodies.

The ductor roller 40 associated with the present invention provides ink to the first intermediate roller 44 from the inking roller 36 as illustrated in FIG. 2 through the oscillatory motion of the ductor roller 40 described above. A second and third intermediate roller 48, 52 continuously engage the first intermediate roller 44, while a fourth intermediate roller 56 and a print roller 60 each continuously engage the third intermediate roller 52. One or more of the first, second, third, fourth, or print rollers 44, 48, 52, 56, 60 may be rotatably driven by the drive system 26 of FIG. 1 and/or may horizontally oscillate (along their respective rotational axis) to further evenly distribute the ink upon the body of a given roller interfacing therewith.

A front and rear transfer roller 64, 68 are positioned below and continuously engage the print roller 60, and such transfer rollers 64, 68 each continuously engage a rotatable plate cylinder 72 having a printing plate 76 of a desired design detachably connected thereto as illustrated in FIG. 2 (the thickness of the printing plate 76 being exaggerated in FIG. 2 to enhance the illustration thereof). Consequently, it can be appreciated that ink is generally transferred from the inking roller 36 to the ductor roller 40, the first intermediate roller 44, the third intermediate roller 52, the print roller 60, the front and rear transfer rollers 64, 68, and then to the printing plate 76 via rotation of at least one of the rollers of the inker 12 by the drive system 26. Although this particular roller configuration is utilized, it can be appreciated that it may be desirable to incorporate as many successive, interconnected/interfacing rollers as possible to further refine the application of ink to the printing plate 76. Consequently, the present invention is not limited to the particular illustrated roller configuration.

The orientation of various of the above-identified rollers may have an effect on the transfer of the ink to the printing plate 76. This is particularly true in the case of the front and rear transfer rollers 64, 68 which directly interface with the plate cylinder 72, which again has the printing plate 76 detachably connected thereto. For instance, the pressure applied by each of the front and rear transfer rollers 64, 68 to the printing plate 76 will directly affect the distribution of the ink applied to the printing plate 76. Moreover, in the event that there is not substantially uniform contact along the entire interface between each of the front and rear transfer rollers 64, 68 and the printing plate 76, the distribution of ink along the printing plate 76 may undesirably vary. In order to allow for adjustment of the position of each of the front and rear transfer rollers 64, 68, which accommodates for each of the foregoing, the present invention incorporates a transfer roller adjustment assembly 164.

Figure 8:
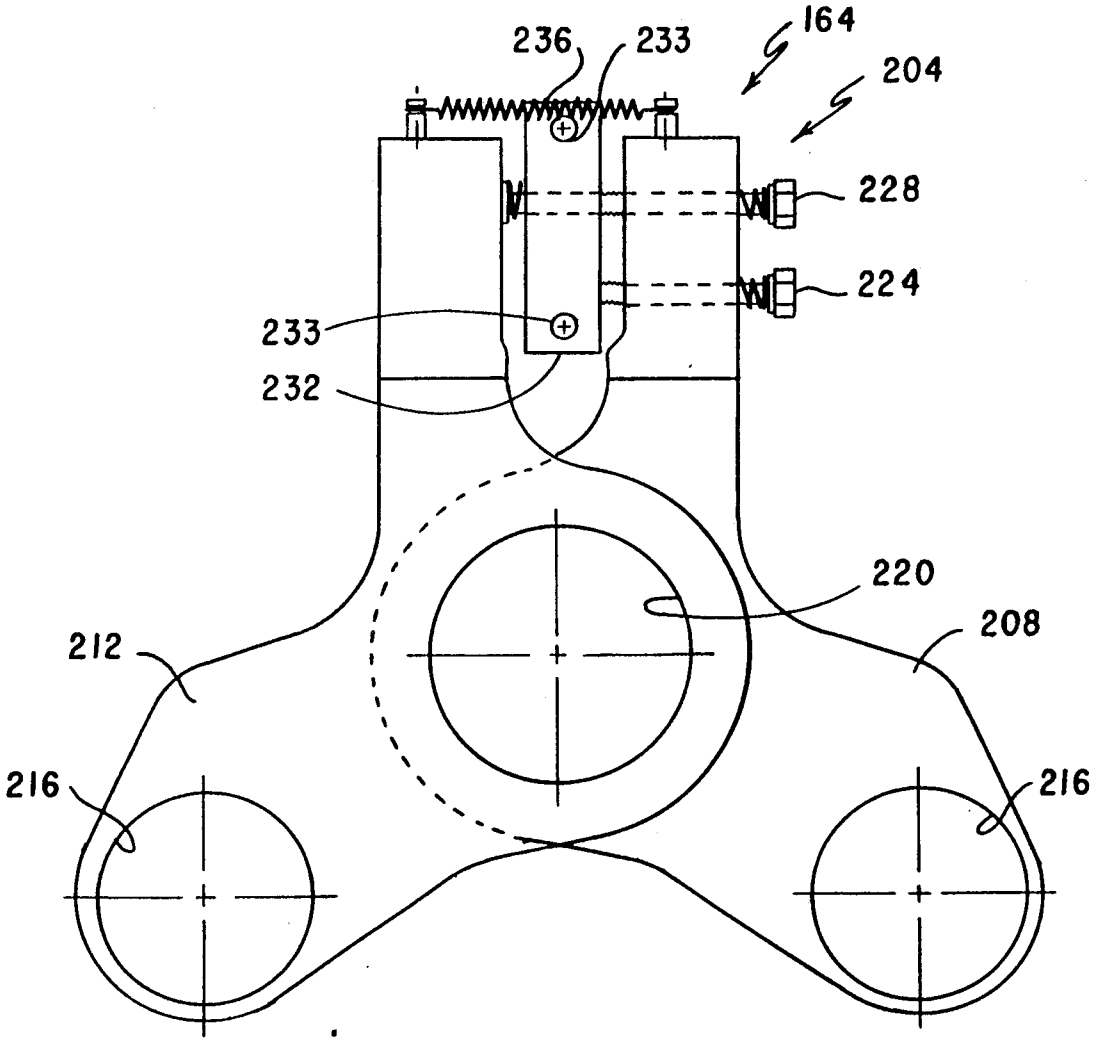
FIG. 8 is a side view of the transfer roller adjustment mechanism of FIG. 7.
Figure 7:
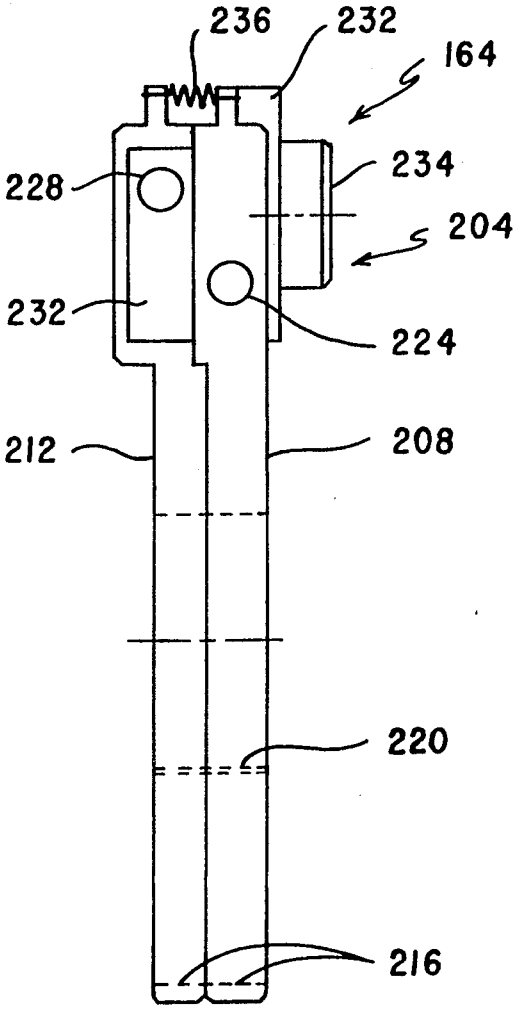
FIG. 7 is a front view of one embodiment of a right-end transfer roller adjustment mechanism of the present invention.

The transfer roller adjustment assembly 164 is illustrated in FIGS. 7–10 and generally includes a left and right assembly 168, 204 for adjusting the left ends 66, 70 and right ends 67, 71, respectively, of the shafts 65, 69 of the front and rear transfer rollers 64, 68, respectively. The right assembly 204 generally includes a right front pivot arm 208, a right rear pivot arm 212, and a stationary block 232 positioned therebetween as illustrated in FIG. 7–8. The stationary block 232 may be attached to the right support plate 20 by passing screws (not shown) through the holes 233 in the block 232 and by positioning the mounting boss 234 within an appropriate cavity (not shown) within the right support plate 20. Therefore, the block 232 provides a stationary surface against which forces may act upon the pivot arms 208, 212 to pivot the transfer rollers 64, 68.

The right front and rear pivot arms 208, 212 are each pivotally mounted on the right end 63 of the print roller shaft 61 or more preferably a boss 58 which supports the shaft 61 (FIG. 1) and which is positioned within the right support plate 20. More particularly, the shaft 61 or boss 58 is received in a print roller shaft hole 220 in each of the pivot arms 208, 212. The right front and rear pivot arms 208, 212 each also include a transfer roller shaft hole 216 for receiving the right ends 67, 71 of the front and rear transfer roller shafts 65, 69, respectively, the holes 216 being positioned on a bottom portion of each of the pivot arms 208, 212. Consequently, the right ends 67, 71 of the shafts 65, 69 of the front and rear transfer rollers 64, 68, respectively, are each pivotally supported by the print roller shaft 61 or the supporting boss 58 thereof.

In order to provide for an independent adjustment of the right ends 67, 71 of the front and rear transfer roller shafts 65, 69, respectively, two separate adjusting screws 224, 228 are utilized. One of the adjusting screws 224 is threadably engaged with the right front pivot arm 208 for engagement with the stationary block 232 such that the right end 67 of the front transfer roller shaft 65 may be pivoted either toward or away from the plate cylinder 72 depending upon the direction of rotation of the adjusting screw 224. A second adjusting screw 228 is threadably engaged and passes through the stationary block 232 for engagement with the upper end of the right rear pivot arm 212 for similar but independent adjustment capabilities of the right end 71 of the shaft 69 of the rear transfer roller 68. As can be appreciated, it may be necessary to incorporate a spring 236 which interconnects the upper ends of the right front and rear pivot arms 208, 212 in order to allow for an adjustment of the right ends 67, 71 of the shafts 65, 69 of the front and rear transfer rollers 64, 69, respectively, which results in a pivoting of the respective front and/or rear transfer rollers 64, 68 away from the plate cylinder 72.

Figure 9:
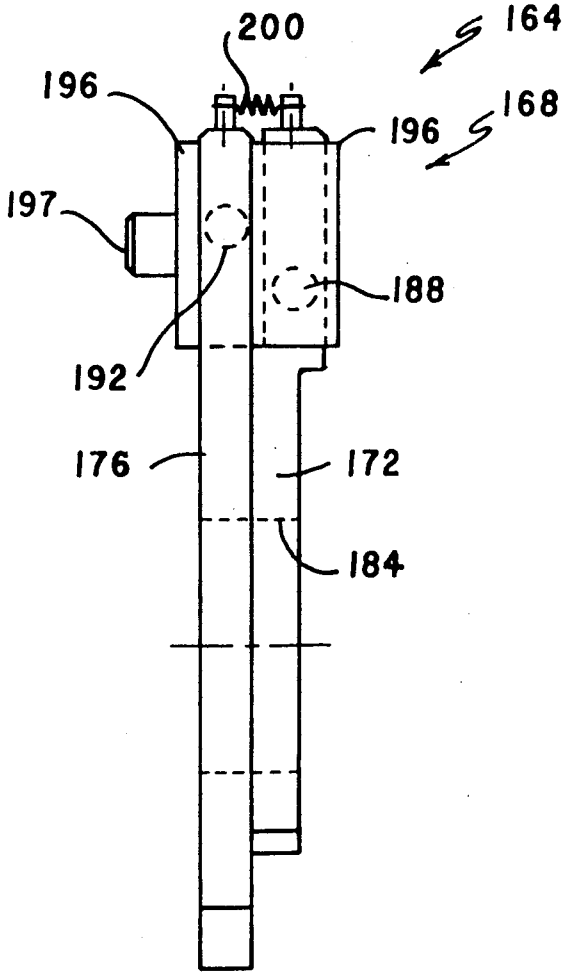
FIG. 9 is a rear view of one embodiment of a left-end transfer roller adjustment mechanism of the present invention.
Figure 10:
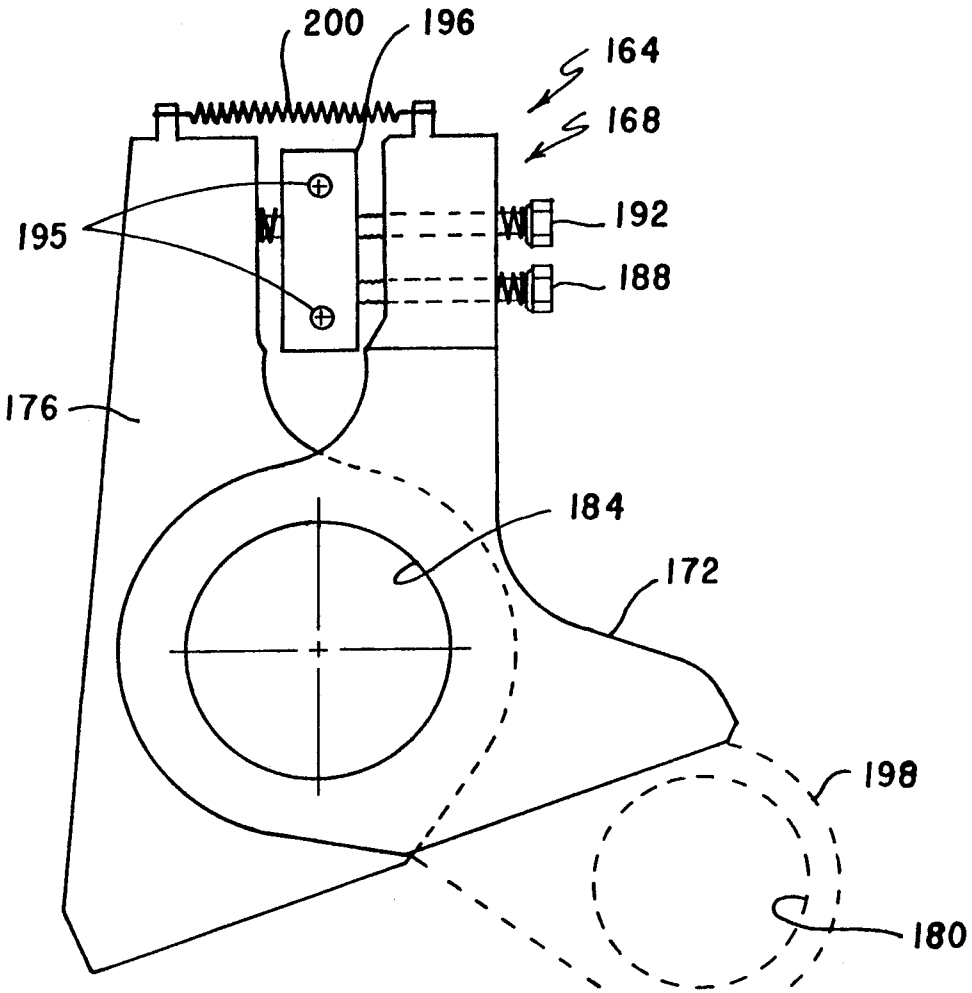
FIG. 10 is a side view of the transfer roller adjustment mechanism of FIG. 9.

The left assembly 168 of FIGS. 9–10 is substantially similar to the right adjustment assembly 204 and performs similar functions, but for the left ends 66, 70 of the shafts 65, 69 of the front and rear transfer rollers 64, 68, respectively, as illustrated in FIGS. 9–10. Consequently, the left assembly 168 includes left front and rear pivot arms 172, 176 which are each pivotally connected to the left end 62 of the print roller shaft 61 or more preferably a boss 57 which supports the left end 62 of the shaft 61 and which is positioned within a cavity in the left support plate 16 (FIG. 1). The print roller shaft 61 or the supporting boss 57 thereof is mounted within the left support plate 16 and is once again received in a print roller shaft hole 184 in each of the pivot arms 172, 176.

The assembly 168 also includes a stationary block 196 which is positioned between the pivot arms 172, 176. The stationary block 196 may be attached to the left support plate 16 by passing screws (not shown) through the holes 195 in the block 196 and by positioning the mounting boss 197 within an appropriate cavity (not shown) on the left support plate 16. Therefore, the block 196 provides a stationary support surface against which forces may act upon to pivot the left ends 66, 70 of the shafts 65, 69 of the front and rear transfer rollers 64, 68, respectively.

In order to allow for efficient removal of one or both of the transfer rollers 64, 68 from the inker 12, the transfer rollers 64, 68 are not directly rotatably mounted on the bottom portions of the pivot arms 172, 176. Instead, a separate supporting bracket 198, shown in dashed lines for the left front pivot arm 176 in FIG. 9, having a transfer roller shaft hole 180 therein is detachably connected to each of the left front and rear pivot arms 172, 176 (again only shown for the left front pivot arm 172 in FIG. 9). Consequently, the left ends 66, 70 of the shafts 65, 69 of the front and rear transfer rollers 64, 68, are pivotally supported by the left end 62 of the print roller shaft 61 or the supporting boss 57 thereof.

In order to provide for independent adjustment capabilities for the left ends 66, 70 of the shafts 65, 69 of the front and rear transfer rollers 64, 68, a separate adjusting screw 188, 192 is provided for the left front and rear pivot arms 172, 176, respectively. One of the adjusting screws 188 is threadably engaged with the left front pivot arm 172 for engagement with the stationary block 196, and another of the adjusting screws 192 is threadably engaged with and passes through the stationary block 196 for engagement with the upper end of the left rear pivot arm 176. Consequently, rotation of the adjusting screw 188 associated with the left front pivot arm 172 pivots the left end 66 of the transfer roller shaft 65 about the print roller shaft 61 (toward the plate cylinder 72 for one direction of rotation and away from the cylinder 72 in the opposite direction). Rotation of the adjusting screw 192 associated with the left rear pivot arm 176 similarly pivots the left end 70 of the rear transfer roller shaft 69 about the print roller shaft 61. Once again, in order to provide for a pivoting of either one or both of the left ends 66, 70 of the front and rear transfer rollers 64, 68 away from the plate cylinder 72, the upper ends of the left front and rear pivot arms 172, 176 may need to be interconnected by a tensioning spring 200.

Based upon the foregoing, it can be appreciated that the transfer roller adjustment assembly 164 associated with the present invention reduces the number of components of the inker 12 which are in the above-defined roller body area 34. More particularly, none of the components of the transfer roller adjustment assembly 164 extend through the roller body area 34, but are instead positioned substantially proximate to the left or right support plates 16, 20. Consequently, the potential for ink, which is propelled away from the rollers of the inker 12 during operation, and collecting on the components of the adjustment assembly 164 in a manner which will produce printing defects on the container body is significantly reduced.

Figure 11A:
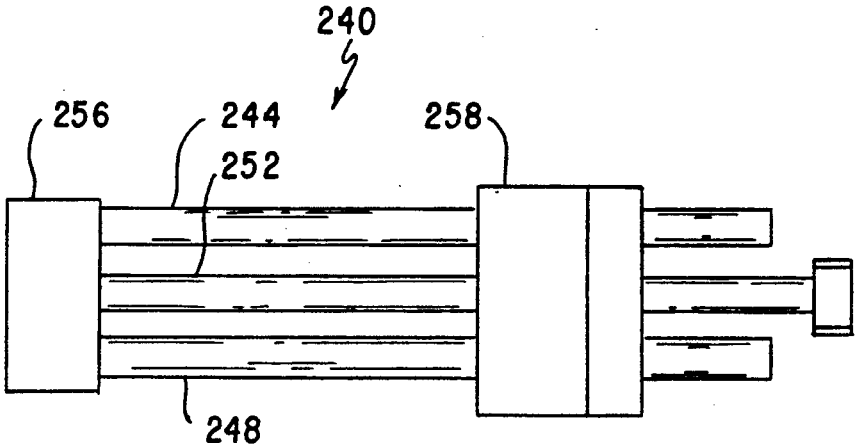
FIGS. 11A-C illustrate a transfer roller adjustment mechanism constructed in accordance with the prior art.
Figure 11B:
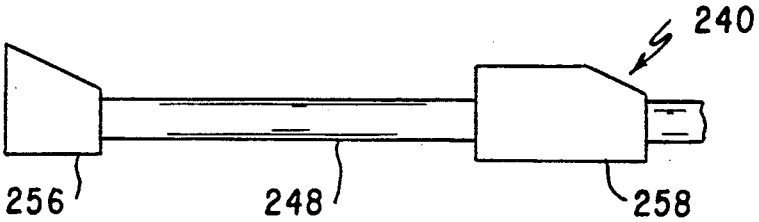
Figure 11C:
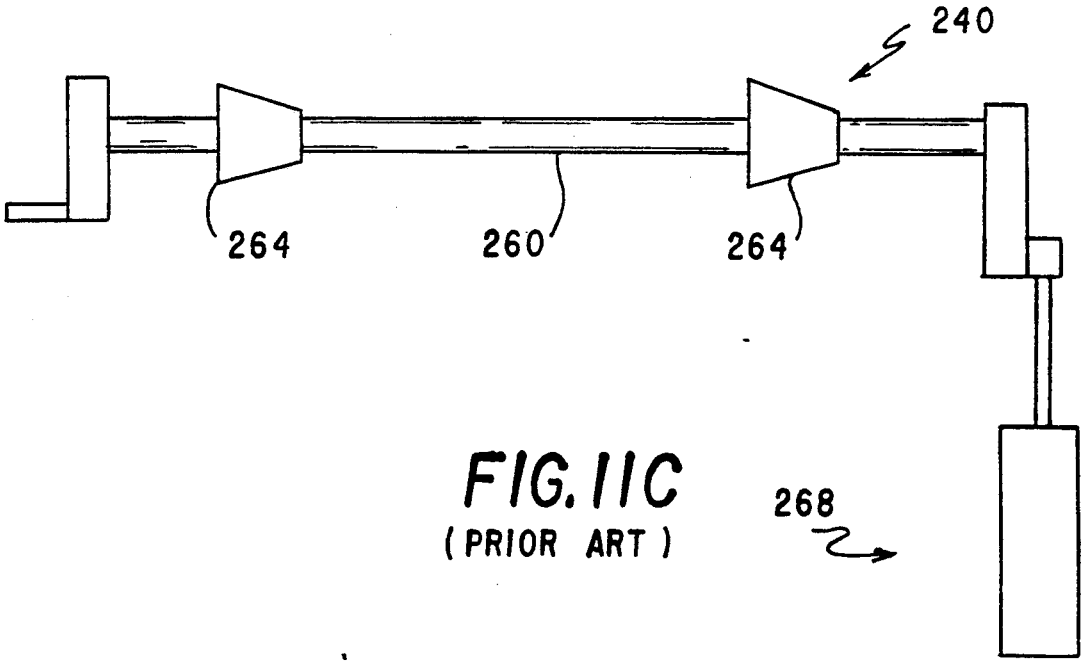
FIG. 11C (PRIOR ART)

One system for adjusting the positioning of transfer rollers generally of the above-described type which is utilized by the above-identified Model 800 Inker is illustrated in FIGS. 11A–C. Generally, the system includes front and rear transfer roller adjustment assemblies for the front and rear transfer rollers, respectively, such transfer rollers being similar to the transfer rollers 64, 68 associated with the present invention and interacting with a plate cylinder similar to the plate cylinder 72. Since both assemblies are similar in the Model 800 Inker, only the front transfer roller assembly 240 is illustrated and will be discussed herein.

The front assembly 240 of the Model 800 Inker extends across the inker and interconnects pivot brackets (not shown) which pivotally connect each of the ends of the front transfer roller effectively to the print roller shaft (i.e., the pivot bracket on the left and right ends of the front transfer roller are interconnected by the front assembly 240). The front assembly 240 includes two displaced slide rods 244, 248 and a screw rod 252 which is positioned therebetween. The slide rods 244, 248 are slidably engaged with two displaced wedge blocks 256, 258, while the screw rod 252 is threadably engaged with such wedge blocks 256, 258.

An activating rod 26 having sloped wedges 264 attached thereto is positioned between the front assembly 240 and the rear assembly (not shown), and thus extends between the left and right support plates of the Model 800 Inker (not shown but similar to plates 16, 20 of the present invention). When it is desirable to pivot the front transfer roller toward the plate cylinder, the activating rod 260 is engaged to rotate and align the sloped portions of its wedges 264 for engagement by the sloped portions of the wedge blocks 256, 258. This may be done by activating the kickout cylinder 268 also illustrated in FIG. 6. Thereafter, the front assembly 240 may be adjusted by rotating the screw rod 252 in either direction to pivot the front transfer roller either toward or away from the plate cylinder by rotation of the screw rod 252 in the appropriate direction. Since the adjustment assembly 240 pivots the entire front transfer roller about the rotational axis of the print roller, a separate mechanism, such as eccentric bearings (not shown), must be used to adjust the front transfer roller to be parallel to the plate cylinder.

As can be appreciated, the front assembly 240, the rear assembly (not shown), and the activating rod 260 of the Model 800 Inker of FIGS. 11A–C extend through an area coinciding with the roller body area 34 defined for emphasizing the features of the present invention. Therefore, the ink which is propelled away from the surfaces of the rollers of the inker utilizing such a system (the Model 800 Inker adjustment system) will collect on such components. As noted above, this increases the potential for ink being deposited in an undesirable and uncontrolled manner, which thereby increases the potential for printing defects on the container bodies. Therefore, the present invention, which removes such components from the defined roller body area 34 while providing for even more effective adjustments of the transfer roller 64, 68, provides advantages not obtainable by the Model 800 Inker.

Figure 12:
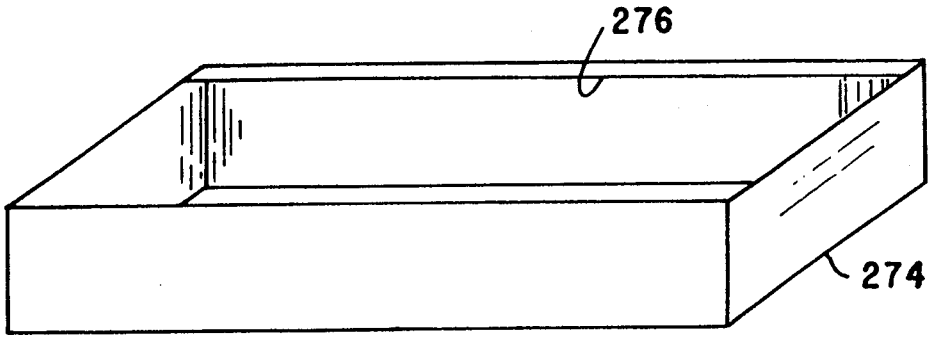
FIG. 12 is a perspective view of a tray for collecting fluids utilized in cleaning the inking apparatus of FIG. 1.
Figure 13:
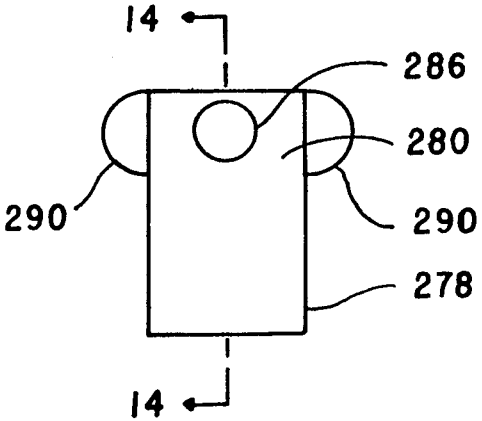
FIG. 13 is a top view of a clip used to retain the tray of FIG. 12 against the inking apparatus of FIG. 1.
Figure 14:
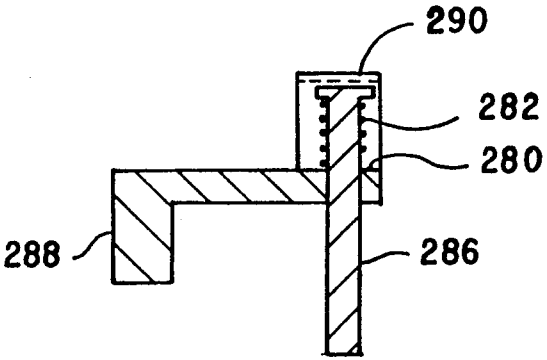
FIG. 14 is a cross-sectional view of the clip of FIG. 13 taken along line 14—14.

Under some circumstances, such as upon completion of a given printing run of a particular container body design, it is necessary to flush the inker 12 to remove any residual ink from the bodies of the various rollers and/or to otherwise clean the rollers for a subsequent printing run. In this regard, an appropriate fluid (e.g., cleaning solvent is flushed through the ink applicator 32 and is allowed to flow through the above-described rollers to remove the ink therefrom. In order to collect this fluid and any removed ink, a tray 274 may be detachably connected to a lower portion of the inker 12 by two clips 278 as illustrated in FIGS. 12–14.

One clip 278 is positioned on each of the left and right support plates 16, 20 as generally illustrated in FIG. 1. Referring to FIGS. 13 and 14 for a more specific illustration of the structure of the clips 278, each clip 278 includes a screw 286 which threadably engages the associated left or right support plate 16, 20 and thus remains substantially stationary relative to remaining portions of the clip 278 during installation of the tray 274. A spring 282 is positioned between the head of the screw 286 and the base 284 of the clip 278 to allow for easy installation and removal of the tray 274. More particularly, when it is desirable to position the tray 274 on the inker 12, the operator merely has to grasp the clip 278, such as by the wing tips 290, and pull the clip 278 away from the associated left or right support plate 16, 20, thereby compressing the associated spring 282. Thereafter, the tray 274 may be positioned against the left and right support plates 16, 20 (e.g., extending across the front of the inker 12) such that when each clip 278 is released, the leg 288 of each clip 278 will contact the tray 274 under its lip 276 to compressively engage the tray 274 against the respective support plate 16, 20 by the extension of each clip's 278 spring 282. Therefore, it can be appreciated that the clips 278 provide an efficient means for installing and removing the tray 274 from the inker 12 (e.g., by not requiring removal of the clip 278 upon completion of the cleaning procedure as would be the case if only screws were used to directly attach the tray to the inker).

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. An apparatus for applying an ink to a printing plate attached to a rotatable cylinder, wherein said ink on said printing plate is transferable to a container body, comprising:

first and second laterally displaced support plates;

first, second, third, and fourth rollers each having a rotational axis substantially parallel to a rotational axis of said cylinder, a roller body, and roller shaft and each being rotatably interconnected with said first and second support plates, said first roller body being interconnected with said second roller body, said third and fourth roller bodies each engaging said second roller body, said third and fourth roller bodies each engaging said cylinder and said printing plate, said third and fourth roller shafts each being rotatably interconnected with said first and second support plates by first and second bracket assemblies, respectively, to allow pivoting of each of said third and fourth rollers about a reference axis;

a roller body area having a width coinciding with a maximum lateral extent of said first, second, third, and fourth roller bodies, said roller body area including each of said first, second, third, and fourth roller bodies and projecting outwardly therefrom;

means for applying said ink to at least a portion of said first roller body;

means for rotating at least one of said first, second, third, and fourth rollers, wherein at least a portion of said ink applied to said first roller body is transferred to said printing plate; and means for adjusting a position of each of said third and fourth roller bodies relative to said printing plate, said entire means for adjusting being positioned externally of said roller body area and comprising means for pivoting each of said third and fourth rollers about said reference axis.

2. An apparatus, as claimed in claim 1, wherein:

said means for pivoting comprises first and second means for pivoting said third and fourth rollers, respectively, about said reference axis, said first and second means for pivoting being independently operable.

3. An apparatus, as claimed in claim 2, wherein:

said first means for pivoting comprises means for independently pivoting a first and second end portion of said third roller about said reference axis.

4. An apparatus, as claimed in claim 2, wherein:

said second means for pivoting comprises means for independently pivoting a first and second end portion of said fourth roller about said reference axis.

5. An apparatus, as claimed in claim 1, wherein:

said reference axis coincides with said rotational axis of said second roller, said first and second bracket assemblies each engaging said second roller shaft and said second roller shaft being supported by said first and second support plates.

6. An apparatus, as claimed in claim 1, wherein:

said means for pivoting comprises means for independently pivoting a first and second end of each of said third and fourth rollers about said reference axis.

7. An apparatus, as claimed in claim 1, wherein:

said first bracket assembly comprises first and second bracket portions connected to first and second end portions of said second roller shaft, respectively, and to first and second end portions of said third roller shaft, said reference axis thereby substantially coinciding with said second roller shaft;

said second bracket assembly comprises third and fourth bracket portions connected to said first and second end portions of said second roller shaft, respectively, and to first and second end portions of said fourth roller shaft, wherein said first and third bracket portions slidably interface and said second and fourth bracket portions slidably interface; and said means for pivoting comprises means for independently exerting a force on each of said first, second, third, and fourth bracket portions to pivot interconnected portions of said third and fourth rollers substantially about said rotational axis of said second roller.

8. An apparatus, as claimed in claim 7, wherein:

said means for exerting a force comprises a separate screw means for engaging each of said first, second, third and fourth bracket portions, said screw means for each of said first and third bracket portions each being further engageable with a first stationary block portion positioned between upper portions of said first and third bracket portions, said screw means for each of said second and fourth bracket portions each being further engageable with a second stationary block portion positioned between upper portions of said second and fourth bracket portions.

9. An apparatus, as claimed in claim 7, further comprising:

a first spring means for interconnecting an end portion of each of said first and second bracket portions; and a second spring means for interconnecting an end portion of each of said third and fourth bracket portions.

10. An apparatus, as claimed in claim 1, further comprising:

fifth and sixth rollers each having a rotational axis substantially parallel to said rotational axis of said cylinder, a roller body, and a roller shaft, wherein said fifth roller body is alternately engageable with said first and sixth roller bodies, said sixth roller body being interconnected with said second roller body.

11. An apparatus, as claimed in claim 10, further comprising:

means for oscillating said fifth roller between a first and second position to alternately engage said fifth roller body with said first and sixth roller bodies, respectively, said means for oscillating being interconnectable with said fifth roller.

12. An apparatus, as claimed in claim 11, wherein said means for oscillating is positioned externally of said roller body area.

13. An apparatus, as claimed in claim 11, further comprising:

means for disconnecting said means for oscillating from said fifth roller.

14. An apparatus, as claimed in claim 1, further comprising:

clip means for detachably connecting a collector means to a supporting portion of said apparatus, said collector means for collecting a fluid used to clean said rollers, said clip means including a spring means and an engaging means and being movable between at least first and second positions, wherein moving said clip means to said first position compresses said spring means and allows for a positioning of said collector means between said engaging means and said supporting portion, and wherein moving said clip means to said second position causes said engaging means to retain said collector means against said supporting portion, said spring means biasing said clip means in said second position.

15. An apparatus for applying an ink to a printing plate attached to a cylinder having a rotational axis, said ink on said printing plate being transferable to a generally cylindrical container body, comprising:

first and second laterally displaced support plates;

first, second, third, and fourth rollers each having a rotational axis substantially parallel to said rotational axis of said cylinder and a roller body and being rotatably interconnected with said first and second support plates;

a roller body area having a width coinciding with a maximum lateral extent of said first, second, third, and fourth roller bodies, said roller body area including each of said first, second, third, and fourth roller bodies and projecting outwardly therefrom;

first and second pivot arms connected to said first and second support plates, respectively, by first and second pivot pins, respectively, said first and second pivot pins being positioned externally of said roller body area and said first and second pivot arms rotatably supporting said second roller;

means for oscillating said second roller between first and second position to alternately engage said second roller body with said first and third roller bodies by pivoting said second roller about an axis coinciding with said first and second pivot pins, said means for oscillating being interconnected with at least one of said first and second pivot arms and positioned entirely externally of said roller body area;

means for disconnecting said means for oscillating from said at least one of said first and second pivot arms to terminate movement of said second roller between said first and second positions, said means for disconnecting being positioned entirely externally of said roller body area;

means for applying said ink to at least a portion of said first roller body; and means for rotating at least one of said first, second, third, and fourth rollers, wherein at least a portion of said ink is transferred to said second, third, and fourth roller bodies, said fourth roller body being interconnected with said third roller body and engaging said cylinder to distribute said ink on said printing plate.

16. An apparatus, as claimed in claim 15, wherein:

said means for oscillating comprises a drive cam and a cam follower engageable with said drive cam, said cam follower being interconnected to said at least one of said first and second pivot arms.

17. An apparatus, as claimed in claim 15, wherein:

said means for disconnecting comprises a cam pivotable between first and second positions, said first position allowing for interconnection of said means for oscillating and said at least one of said first and second pivot arms, said second position displacing said means for oscillating from said said at least one of said first and second pivot arms.

18. An apparatus, as claimed in claim 15, wherein:

said means for oscillating comprises:

a cam follower positioned on said at least one of said first and second pivot arms; and a drive cam engageable with said cam follower, wherein said means for disconnecting displaces said cam follower away from said drive cam.

19. An apparatus, as claimed in claim 18, wherein:

said means for disconnecting comprises a lock-out cam movable between first and second positions, said lock-out cam being disengaged with one of said first and second pivot arms when in said first position, said lock-out cam engaging said one of said first and second pivot arms when in said second position to displace said cam follower from said drive cam.

* * * * *